United States Patent [19]

Aranzabal

[11] 4,047,407

[45] Sept. 13, 1977

[54] PADLOCK

[75] Inventor: Feliciano Aranzabal, Mondragon, Spain

[73] Assignee: Feliciano Aranzabal Y Cia, S.A., Spain

[21] Appl. No.: 648,753

[22] Filed: Jan. 13, 1976

[30] Foreign Application Priority Data

Feb. 3, 1975 Spain ..... 209606

[51] Int. Cl.[2] ..... E05B 67/02

[52] U.S. Cl. ..... 70/52; 70/372

[58] Field of Search ..... 70/51, 52, 372, 373, 70/378, 38–39

[56] References Cited

U.S. PATENT DOCUMENTS 2,116,965 5/1938 Schoorel ..... 70/52 X

*Primary Examiner*—Robert L. Wolfe

*Attorney, Agent, or Firm*—Ostrolenk, Faber, Gerb & Soffen

[57] ABSTRACT

In a padlock having a plurality of peg housings in cylindrical form and opening onto a side surface of the padlock, a common width for closing all of the peg housings, which lid on its inside surface carries a plurality of projections, each for insertion into a peg housing and means for holding the lid to the padlock body.

6 Claims, 6 Drawing Figures

PADLOCK

The invention concerns generally the manufacture of padlocks; to be more precise, and as a new industrial result, the model provides a new padlock in which mention should be made, as the most important feature, of a new conception in the closing system of the peg housings, and also a special arrangement to fix or hold the padlock cylinder.

In some types of padlocks known, the peg housings are closed with individual stoppers or using a common riveted lid. This embodiment calls for the padlock to be closed in an operation prior to the finishing treatments and processes, such as nickel plating, chrome plating, painting, polishing, etc., which in some cases is the reason why the padlock does not work correctly.

In accordance with the invention, it has been foreseen to close the aforementioned peg housings by a lid specially designed for this purpose, which lid is assembled on the general body of the padlock after performing all the finishing operations and treatments.

This lid is made up of a suitably shaped and dimensioned part, which on its inside plane (according to the assembly position) is fitted with projections, preferably, but not exclusively, like cylindrical lugs, which coincide with the peg housings. The diameter of these lugs is slightly bigger so that they fit into and keep in their respective housings, thereby ensuring that the lid is efficiently held on the padlock body.

According to the invention, other shanks can be foreseen to be housed in other holes, made for the purpose in the padlock body, which holes are irrespective of the peg housings, and which shank is preferably intended to hold the cylinder on the padlock body.

According to another characteristic detail of the invention, it has been foreseen that the lid which covers the peg housings, adapts itself tightly onto the padlock body to which it is permanently joined, forming a bas-relief surface with the latter. By means of this layout, lids can be arranged, which may or may not be provided with the aforementioned retention lugs, since the actual lid is tightly housed in a slot provided in the padlock body. For this embodiment, the padlock body shall have, in the suitable place, a slot of the same shape as the periphery of said lid and with the correct dimensions to enable it to fit in tightly. The lid adapted in this way is efficiently held in place, having a bas-relief surface which makes it very difficult to identify its position.

Furthermore, the invention includes another improvement consisting of building into said closing plate, a shank, longer than the shanks which close the peg housings. This shank is inserted inside the padlock body forming the means of holding the padlock cylinder. This embodiment is not exclusive, as the invention also foresees the possibility of having a plate provided with a single stud which, entering one side of the padlock body, makes its end fit into a groove made in the periphery of the cylinder holding it in this way in the padlock body. This embodiment is very suitable for small sized padlocks in which the peg housings and the springs housed in them are short and so two types of closing plates are possible, one of the lids can be simply a flat plate on which the peg springs rest direct. On the opposite side of the padlock body, a second plate will be placed, provided with a single stud or shank which enters the padlock body until its free end is placed inside the peripheric neck of the cylinder to hold it.

A fuller idea of the invention is furnished by the following description in which reference is made to the annexed drawings which show the preferred details of the invention.

Figure 6:
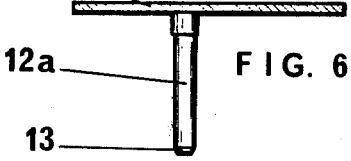

FIG. 6, according to another embodiment of the invention, shows a plate provided with a single stud designed to hold the cylinder inside the padlock body.

Commenting now on these drawings, it is stated that the general body of the padlock is marked with nΩ 1, 2 being the peg housings and 3 the slot made in one side of the said body 1 in which slot the lid 4 is housed, provided on its inner face, with conventional appendages, which in the case shown are cylindrical lugs 5 which face each other and are housed in the aforementioned housings 2.

Figure 1:
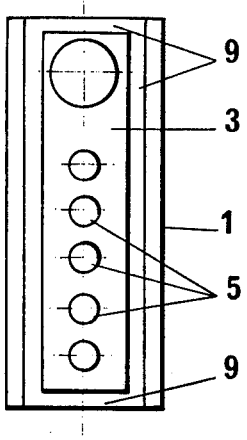
FIG. 1 shows a side view of the padlock body, the alignment of the peg housings being seen, as well as the slot into which the lid is fitted which closes these housings.
Figure 2:
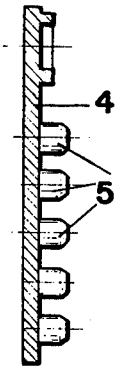
FIG. 2 shows the lid which closes the peg housings seen in a cross-section along the A—A line of FIG. 3.
Figure 3:
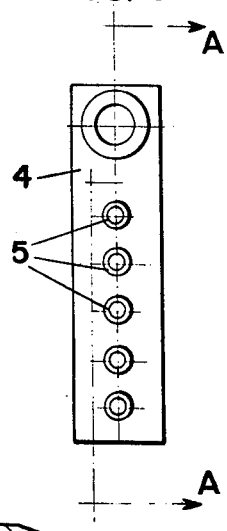
FIG. 3 is a view of the lid from its inner plane.
Figure 4:
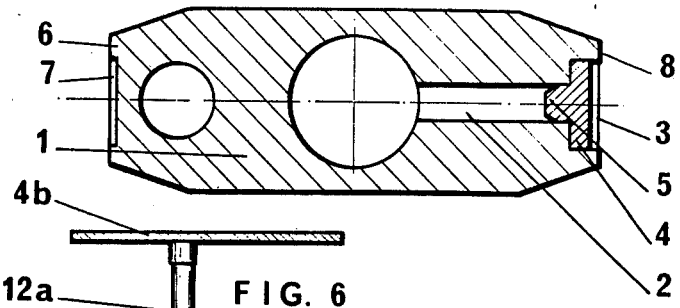
FIG. 4 is a horizontal cross-section view of the padlock body with the built-in lid which is placed in bas-relief.

In FIG. 4, it can be seen that the body 1, in its side 6, has a bas-relief 7 exactly the same as the bas-relief formed in the opposite side 8 through fitting the lid 4 inside the slot 3. The side 8 with its slot, forms a ring 9 whose configuration coincides and is capable of receiving the plate 4 concentrically.

Figure 5:
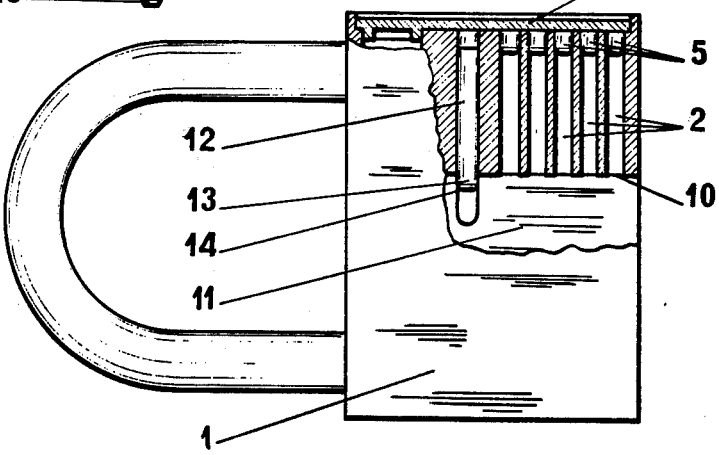
FIG. 5 shows an improved padlock, according to the invention, cut conventionally, in which a plate has been installed with lugs which close the peg housings and which furthermore has a stud designed to hold the cylinder.

Commenting now on the embodiment shown in FIG. 5, it can be seen that plate 4*a*, on its inner face, has a series of cylindrical lugs (5), which are inserted into the holes (2) of the body (1). It can also be seen in FIG. 5 that the plate 4*a* has another shank, greater in length 12 which enters the body (1) and its end 13 goes into the groove 14 which the cylinder or plug 11 has, the latter being held inside the body 1 of the padlock.

The plug 11 is assembled as follows: first, this plug 11 is inserted in the body 1 of the padlock and then the plate 4*a* is placed, fitting it into its housing (3). The retention shank (12) inserts its free end (13) in the groove (14) made in the plug 11 the latter being held inside the body (1) of the padlock.

The plate 4*a* with the lugs 5 closes the alignment of holes 2 of the padlock pegs and also, with the longest shank (12), the plug is held inside the body (1). The plate 4*a* is fitted and kept in the housing (3), being placed in bas-relief.

In another embodiment of the invention, a plate 4*b* is foreseen, provided with a single shank 12*a*, as shown in FIG. 6*a*, which shank is designed to hold the plug (11). In this case, the aforementioned plate (4*b*) is fitted in the opposite side than the plate (4) which has pegs (5). This layout is also applicable for small sized padlocks, which, as the pegs and springs are short in length, the lugs (5) are simply removed from the closing plate, and the padlock springs rest on the inside face of the smooth plate.

In the object making up the invention, modifications in detail can be introduced, provided they do not alter the essential nature of the object disclosed.

I claim:

1. An improved padlock comprising:

a padlock body having a cylindrical bore passing therethrough, said bore being adapted to receive a lock plug;

said padlock body also including a plurality of tumbler receiving passages arranged in a predetermined array and extending from said bore to one side of said body, each of said passages having a predetermined cross-section;

a lid to cover said one side of said padlock body, said lid comprising a plate having a sufficient size to extend past and cover all of said passages;

a first plurality of lugs projecting from said lid in an array corresponding to said array of said passages, each said lug corresponding to a different said passage and having a cross-section approximately equal to that of said corresponding passage, the length of each lug being less than the length of its corresponding passage whereby said lugs do not extend into said cylindrical bore.

2. The improved padlock of claim 1, wherein each said tumbler receiving passage and its respective said lug are of cylindrical cross section.

3. The improved padlock of claim 1, wherein said one side of said body has a recess defined therein, said recess being shaped such that said lid securely fits in said recess, and said lid being securely fitted in said recess.

4. The improved padlock of claim 3, wherein said recess is deeper than the height in said recess of said lid, and said lid is in bas-relief in said recess.

5. The improved padlock of claim 1, further comprising a shank attached to and projecting from said lid and being of a length sufficient to extend into said cylindrical bore and to engage said lock plug when said lid is in operational engagement with said one side of said padlock body;

a shank housing in said body extending from said one side of said padlock body to said cylindrical bore so that said shank may extend into said bore and hold said plug when said lid is in operational engagement with said one side of said body.

6. The improved padlock of claim 5, wherein said plug has a receiving groove that is aligned with and is a continuation of said shank housing; said shank being of a length sufficient to extend into said receiving groove when said lid is in operative engagement with said one side of said padlock body.

* * * * *